US006981850B1

(12) United States Patent
Maltbie et al.

(10) Patent No.: US 6,981,850 B1
(45) Date of Patent: Jan. 3, 2006

(54) APPARATUS AND METHOD FOR PRODUCING A PRESSURIZED VAPOR STREAM

(75) Inventors: Brian Norman Maltbie, Amherst, NY (US); Norman Henry White, Tonawanda, NY (US)

(73) Assignees: Praxair Technology, Inc., Danbury, CT (US); Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/947,215

(22) Filed: Sep. 23, 2004

(51) Int. Cl.
*F04B 9/08* (2006.01)
*F04B 23/14* (2006.01)
*F17C 13/02* (2006.01)

(52) U.S. Cl. ..... 417/201; 417/382; 417/390; 62/50.2; 62/50.6; 60/456; 60/486

(58) Field of Classification Search ..... 417/199.1, 417/201, 382, 390, 367; 60/456, 486; 122/26; 62/50.2, 50.6
See application file for complete search history.

(56) References Cited

U.S. PATENT DOCUMENTS 4,197,712 A 4/1980 Zwick et al. ..... 62/53
4,409,927 A 10/1983 Loesch et al. ..... 122/26
4,438,729 A 3/1984 Loesch et al. ..... 122/26
4,458,633 A * 7/1984 Loesch et al. ..... 122/26
4,738,115 A 4/1988 Goode ..... 62/53
5,551,242 A 9/1996 Loesch et al. ..... 62/50.3

* cited by examiner

*Primary Examiner*—Charles G. Freay
(74) *Attorney, Agent, or Firm*—David M. Rosenblum

(57) ABSTRACT

A cryogenic stream is pumped by a cryopump and then vaporized in a vaporizer to produce the pressurized vapor stream. The cryopump is driven by a transmission that is in turn driven by a hydraulic fluid. The hydraulic fluid flows within a hydraulic fluid circuit having first and second hydraulic fluid flow paths. The first of the flow paths is used to drive the hydraulic transmission. The second of the flow paths is dedicated to raising heat. Hydraulic fluid is circulated within the flow path by hydraulic fluid pumps and the amount of heat generated is controlled by adjustable back pressure valves. The adjustable back pressure valves in both fluid flow paths can be adjusted to control the degree to which heat is added to the vaporizer and therefore the pressurized vapor stream. The hydraulic fluid pumps can be driven by diesel engines. Heat may also be recovered from the diesel engines and gear oil used in pumps and the cryopump to also help vaporize the pressurized liquid stream. The aforesaid system of first and second pumps driven by an engine and first and second flow paths can be replicated to allow for expansion of pumping capacity.

18 Claims, 1 Drawing Sheet

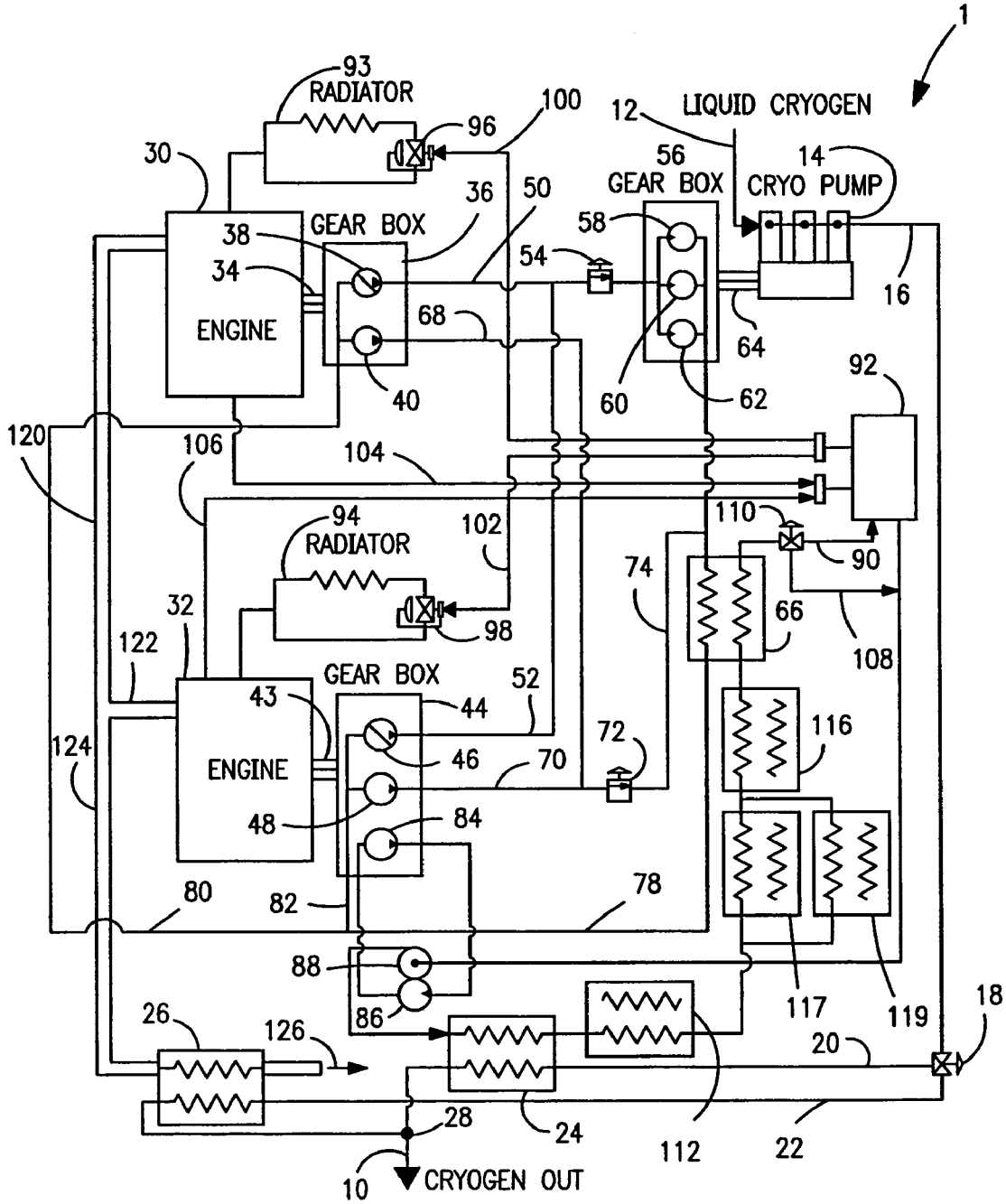
1
93
RADIATOR
96
100
12
LIQUID CRYOGEN
30
56
14
GEAR BOX
CRYO PUMP
36
50
38
GEAR BOX
58
34
54
16
ENGINE
68
64
92
40
60
62
120
106
104
110
94
RADIATOR
102
90
74
32
66
98
108
122
GEAR BOX
52
43
44
116
124
ENGINE
46
70
72
48
84
80
82
78
88
86
117
119
18
26
126
20
28
24
112
22
10
CRYOGEN OUT

APPARATUS AND METHOD FOR PRODUCING A PRESSURIZED VAPOR STREAM

FIELD OF THE INVENTION

The present invention relates to an apparatus and method for producing a pressurized vapor stream in which a cryogenic liquid stream is pumped by a cryopump to produce a pressurized liquid stream and then subsequently vaporized to produce the pressurized vapor stream. More particularly, the present invention relates to such an apparatus and method in which heat for the vaporization of the pressurized liquid stream is obtained from a hydraulic fluid circuit having a back pressured flow path to drive the cryopump and to generate part of the heat and another back pressured flow path to generate a further part of the heat required for vaporization.

BACKGROUND OF THE INVENTION

There are a variety of industrial processes that require a pressurized vapor. Pressurized vapor is often produced by pumping a cryogenic liquid and then vaporizing the pumped liquid. Typical cryogenic liquids are those obtained from the fractionation of air into its separate components, namely, liquid nitrogen and liquid oxygen.

Oil and gas drilling applications are key examples of industrial processes that involve the use of pressurized vapor and in particular, pressurized nitrogen. For instance, in enhanced oil recovery, oil fields are pressurized with nitrogen. Nitrogen is also used in gas lift operations where it is injected down hole to decrease the density of oil and help to drive the oil to the surface. Additionally, pressurized nitrogen is often used in various oil and gas well completion operation such as in fracturing, acidizing and cementing.

In oil and gas well drilling and completion applications, a pressurized nitrogen stream is obtained, on site, by pumping liquid nitrogen to pressure and then vaporizing the liquid nitrogen. The pump is driven by an internal combustion engine. The heat required for the vaporization is generated directly from combustion taking place within the internal combustion engine and from shaft work performed by the engine on hydraulic fluid that can be converted into heat energy.

An example of such a device is described in U.S. Pat. No. 4,738,115. The pumping and vaporization system shown in this patent utilizes a diesel engine coupled by a transmission to a dynamometer, a variable displacement hydraulic pump, a fixed displacement lube oil pump and a fixed displacement hydraulic pump. The variable displacement hydraulic pump forces hydraulic fluid to a variable displacement hydraulic motor that in turn drives the cryopump used in pumping liquid nitrogen. The lube oil pump circulates lubrication oil that is used in the various items of equipment and the fixed displacement hydraulic pump drives a circulation pump to circulate a coolant throughout a coolant circuit. The coolant is introduced into heat exchanger to vaporize the liquid nitrogen. Although there is a minor amount of heat that is transferred from the lube oil pump and the fixed displacement pump to the coolant, the majority of the heat required for the vaporization of the liquid nitrogen is generated by a dynamometer. Increasing the load on the dynamometer increases both engine heat output and also, heat to the coolant.

Another example of a nitrogen pumping and vaporization system is disclosed in U.S. Pat. No. 4,438,729. This patent utilizes two internal combustion engines. The first of the internal combustion engine drives a nitrogen pump through a transmission to pressurize the nitrogen. A transmission retarder varies the load on such engine and generates heat that is dissipated into a cooling fluid. The second internal combustion engine drives three hydraulic pumps against adjustable back pressure valves to provide a variable load on the second engine. The heat generated is also transferred to the cooling fluid. Liquid nitrogen is vaporized in a heat exchanger from exhaust gases from the internal combustion engine. It is then subsequently superheated by the heated coolant.

U.S. Pat. No. 4,197,712 discloses a system in which a single engine drives a variable displacement pump to pump oil to a hydraulic transmission that is coupled to a cryogenic pump. Another pump is driven by the same engine to pump oil through a vaporizer and heat exchanger that is used to vaporize the liquid nitrogen. The flow circuit used in driving the hydraulic transmission is selectively back pressured by an adjustable back pressure valve to control the amount of heat generated.

The prior art as disclosed in the above referenced patents presents rather complex systems that have a rather limited range of control. For instance, in U.S. Pat. No. 4,738,115, the amount of heat generated can only be controlled through the loading on the dynamometer. Similarly, in U.S. Pat. No. 4,197,712, the amount of heat generated is controlled by adjustment of the single adjustable back pressure valve employed in the hydraulic circuit used to drive the pump. While U.S. Pat. No. 4,438,729 employs both a adjustable back pressure valve and a transmission retarder to provide two points of adjustment and therefore, the potential of greater heat control, it is difficult, if not impossible, to accurately adjust a transmission retarder and therefore, the amount of heat generated in the hydraulic circuit used in powering the cryopump. Furthermore, the use of such equipment as dynamometers and transmission retarders present unwanted expense and complexity.

A further deficiency in pressurization systems of the prior art is that such systems it is not easily scalable to provide apparatus that is efficient for a particular operation. For instance, in any of the patents discussed above if a greater flow rate of nitrogen is required for a particular application, engine size must be increased to handle the increased pumping and vaporization duty.

As will be discussed, the present invention provides a system for pressurizing and vaporizing a cryogenic liquid that has a greater degree of control than prior art devices and is amenable to be scaled up or down without simply increasing or decreasing the size of the internal combustion engine utilized in such system. Moreover, the system of the present invention is less complex and uses less expensive components than prior art systems.

SUMMARY OF THE INVENTION

In one aspect, the present invention provides an apparatus for producing a pressurized vapor stream. In accordance with such invention, a cryopump pumps a cryogenic stream and thereby produces a pressurized liquid stream. In this regard, the term "cryogenic stream" as used herein and in the claims includes all streams that are not liquid under standard temperature and pressure conditions, for instance, nitrogen, oxygen, carbon dioxide, natural gas and etc. A hydraulic transmission is provided to drive the cryopump. At least one hydraulic power generation system is also provided that has a source of shaft power and first and second hydraulic pumps driven by the source of shaft power. The first of the hydraulic pumps is a variable displacement pump. A hydraulic flow circuit is provided for circulating the hydraulic fluid.

The hydraulic flow circuit has at least first and second hydraulic fluid flow paths for the hydraulic fluid. The first of the hydraulic fluid flow paths connects the first of the hydraulic pumps to the hydraulic transmission so that adjustment of pumping output of the first of the hydraulic pumps controls pressurization of the cryogenic liquid stream. The second of the hydraulic fluid flow paths is connected to the second of the pumps.

First and second adjustable back pressure valves are connected to the first and second hydraulic flow paths, respectively, downstream of the first and second of the hydraulic pumps, to allow for independent adjustment of heat generation within hydraulic fluid flowing in the first and second flow paths. At least a heat exchanger indirectly exchanges heat from the hydraulic fluid to the pressurized liquid stream, thereby to vaporize at least part of the liquid stream and form the pressurized vapor stream.

It is to be further pointed out that the use of the term "vaporize" and the like herein and in the claims does not necessarily indicate a simple phase change from a liquid state to a vapor state. The reason for this is that cryogenic streams are most often pumped to a supercritical state so that thermodynamically there is no distinction between liquid and vapor. Such a cryogenic temperature fluid is for purposes herein is a cryogen liquid whether it is above or below the critical pressure and therefore, the application of heat is for purposes of the description herein and in the claims "vaporization" taking place within a "vaporizer" whether or not the addition of heat converts the supercritical fluid to a vapor below the critical pressure or whether a pumped liquid, below the critical pressure, vaporizes into a vapor.

There are many advantages of the present invention as set forth above over the prior art. The foremost advantage is that the independent control of backpressure in both the first and second hydraulic fluid flow paths by adjustable back pressure valves controls that amount of heat generated more precisely than prior art devices so that the pumping output and the required heat transfer duty can be closely matched on a broad range of potential operation. It goes without saying that backpressure valves are far less complex and expensive devices than dynamometers and provide more precise control than transmission retarders. Furthermore, as will become apparent, the present invention is easily scalable by simply adding hydraulic power generation systems and sets of first and second flow paths.

Heat exchange between the hydraulic fluid and the pressurized liquid stream can be effectuated with the use of a heat transfer fluid, which can simply be engine coolant. In this regard, the heat exchanger can be a hydraulic fluid heat exchanger positioned within the hydraulic flow circuit downstream of the second of the adjustable back pressure valves and the hydraulic transmission and a vaporizer can be connected to the pressurized liquid stream, downstream of the cryopump. A heat transfer fluid circuit is connected to the hydraulic fluid heat exchanger and the vaporizer so that the heat is indirectly transferred from the hydraulic fluid to the heat transfer fluid circulated within the heat transfer fluid circuit by a circulation pump and then from the heat transfer fluid to the at least part of the pressurized liquid stream.

As alluded to above, the source of shaft power can be an internal combustion engine that generates a heated exhaust. First and second pressurized liquid flow paths are each, at one end, connected to a diverter valve that is in turn connected to the cryopump. This allows the flow of the pressurized liquid to be divided between the first and D-21451 second pressurized flow paths. The first of the pressurized liquid flow paths is connected to the vaporizer to vaporize the part of the pressurized liquid stream. The second of the pressurized liquid flow paths is connected to an exhaust gas heat exchanger to indirectly transfer further heat from the heated exhaust to vaporize a remaining part of the pressurized liquid stream flowing within the second of the pressurized liquid flow paths. The first and second pressurized liquid flow paths are connected to one another, downstream of the vaporizer and exhaust gas heat exchanger, to discharge the pressurized vapor.

As mentioned above with respect to the scalability of the present invention, the at least one hydraulic power generation system can be a first hydraulic power generation system and a second hydraulic power generation system, each having its own internal combustion engine. The internal combustion engine that providing the source of shaft power for the first hydraulic power generation system can be thus referred to as a first internal combustion engine and the internal combustion engine providing the source of shaft power for the second hydraulic power generation system is a second internal combustion engine. In such embodiment, the at least first and second hydraulic fluid flow paths comprise two sets of the first and second hydraulic fluid flow paths. One of the two sets of the first and second hydraulic fluid flow paths are connected to the first hydraulic power generation system and the other of the two sets of the first and second hydraulic fluid flow paths connected to the second hydraulic power generation system. The first of the hydraulic fluid flow paths of both sets of first and second hydraulic fluid flow paths are connected to the first adjustable back pressure valve and the second of the hydraulic fluid flow paths of both sets of the first and second hydraulic fluid flow paths are connected to the second adjustable back pressure valve.

Preferably, in any embodiment of the present invention, the hydraulic fluid heat exchanger is connected to both the first and second hydraulic fluid flow paths so that hydraulic fluid from the first and second hydraulic fluid flow paths mixes.

Each of the first and second internal combustion engines can be a liquid-cooled diesel engine having a radiator. The engine water jackets of each of the first and second combustion engines is directly connected to the heat transfer fluid circuit downstream of the hydraulic fluid heat exchanger so that the heat transfer fluid is, in part, introduced into the first and the second internal combustion engines as coolant and is further heated by the first and second internal combustion engines.

Yet further heat can be recovered for vaporization by provision of cryopump, hydraulic pump and engine turbocharger through heat exchangers located between the hydraulic fluid heat exchanger and the vaporizer. The aforesaid devices allow for the transfer of the further heat from cryopump lubricant, hydraulic pump case drain flow for the first and second hydraulic pumps and charge air from engine turbochargers of the first and second internal combustion engines.

In any embodiment of the present invention, the hydraulic transmission is a gearbox that is preferably driven by at least one hydraulic motor.

In another aspect of the present invention, a method of producing a pressurized vapor stream is provided. In accordance with such method, a cryogenic stream is pumped to produce a pressurized liquid stream. The pressurized liquid stream is vaporized to produce the pressurized vapor stream.

The hydraulic fluid is pumped through at least first and second hydraulic fluid flow paths of a hydraulic flow circuit that circulates the hydraulic fluid. A cryopump provided to pump the cryogenic stream is driven by hydraulic fluid pumped within the first of the hydraulic fluid flow paths to a hydraulic transmission coupled to the cryopump. Heat is generated within the hydraulic fluid flowing within the first and second hydraulic fluid flow paths and the amount of heat generated is independently controlled by controlling first and second adjustable back pressure valves located within the first and second of the flow paths, respectively. The heat is transferred from the hydraulic fluid to at least in part vaporize the pressurized liquid stream. Pumping output is adjusted within the first of the flow paths to control flow rate of the liquid stream.

Heat can be indirectly exchanged to the pressurized liquid stream by indirectly exchanging the heat from the hydraulic fluid downstream of the second of the adjustable back pressure valves and the hydraulic transmission to a heat transfer fluid. The heat transfer fluid is circulated within a heat transfer fluid circuit. The heat exchange fluid, after having been heated by the hydraulic fluid, transfers heat to the pressurized liquid stream.

The hydraulic fluid can be pumped within the first and second hydraulic fluid flow paths by first and second hydraulic pumps. The first of the hydraulic pumps can be a variable displacement pump. The pumping output in the first of the hydraulic flow paths can thereby be adjusted by adjusting the first of the hydraulic pumps.

The first and second hydraulic pumps can be driven by an internal combustion engine that generates a heated exhaust. The pressurized liquid stream can be diverted between first and second pressurized liquid flow paths. Part of the pressurized liquid stream is vaporized within the first pressurized liquid flow path with the heat generated within the hydraulic fluid. A remaining part of the pressurized liquid stream can be vaporized through indirect heat exchange with exhaust gases produced by the internal combustion engine.

In a specific embodiment, the internal combustion engine can be a first internal combustion engine and the first and second hydraulic pumps can be a first set of first and second hydraulic pumps driven by the first internal combustion engine. The at least first and second hydraulic fluid flow paths can comprise two sets of the first and second hydraulic fluid flow paths. One of the two sets of the first and second hydraulic fluid flow paths is connected to the first set of the first and second hydraulic pumps. The hydraulic fluid within the other the two sets of the first and second hydraulic fluid flow paths is pumped by a second set of the first and second hydraulic pumps driven by a second internal combustion engine. The second internal combustion engine generates further heated combustion gases that indirectly exchange heat with the remaining part of the pressurized liquid stream. Back pressure in the first of the hydraulic fluid flow paths of both of the two sets of the first and second hydraulic fluid flow paths is adjusted by the first adjustable back pressure valve. Similarly, back pressure in the second of the hydraulic fluid flow paths of both of the two sets of the first and second hydraulic fluid flow paths is adjusted by the second adjustable back pressure valve.

In any embodiment, the hydraulic fluid from the first and second hydraulic fluid flow paths can mix prior to exchanging heat with the heat transfer fluid.

The heat transfer fluid can be further heated after the heat exchange between the hydraulic fluid and the heat transfer fluid by introducing a portion of the heat transfer fluid as coolant into the first and second internal combustion engines. After having been utilized as a coolant, the portion of the heat transfer fluid circulated to the first and second internal combustion engines can be combined with a remaining portion of the heat transfer fluid.

Further heat may be transferred to the heat transfer fluid from cryopump lubricant, hydraulic pump case drain flow for the first and second hydraulic pumps, and charge air from engine turbochargers of the first and second internal combustion engines.

In any embodiment of the present invention, the liquid cryogen can be liquid nitrogen.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which the sole FIGURE is a schematic of an apparatus for carrying out a method in accordance with the present invention.

DETAILED DESCRIPTION

With reference to the sole FIGURE, an apparatus 1 in accordance with the present invention as illustrated for producing a pressurized vapor stream 10 which, for exemplary purposes can be made up of nitrogen.

A cryogenic stream 12 is pumped by a cryopump 14 to produce a pressurized liquid stream that flows through a conduit 16 from the cryopump 14. Conduit 16 is optionally connected to a diverter valve 18 that is connected to conduits 20 and 22 that provide first and second pressurized liquid flow paths, respectively. The first of the pressurized liquid flow paths provided by conduit 20 is connected to a vaporizer 24 which functions to vaporize a pressurized liquid stream flowing within conduit 20. Vaporizer 24 can be a water bath vaporizer of shell and tube design. The pressurized liquid stream flowing into the second of the pressurized liquid flow paths provided by conduit 22 passes to an exhaust gas vaporizer 26 and then to junction 28 connecting conduits 20 and 22. Exhaust gas heat vaporizer 26 can be of multi pass tube design. Pressurized vapor stream 10 is discharged from junction 28.

As will be discussed in more detail, vaporization of the pressurized liquid stream is accomplished through recovery of engine shaft power as heat within pumped hydraulic fluid. The engine shaft power is produced by first and second liquid-cooled diesel engines 30 and 32, respectively. For an oil and gas recovery operation, each of the two diesel engines can be 500 HP turbocharged diesel engines that can be obtained from a variety of sources. The heat produced by such recovery is transferred to the pressurized liquid stream within vaporizer 24. Additionally, energy carried in the engine exhaust can be transferred to the pressurized liquid stream within exhaust gas heat vaporizer 26.

As may be appreciated, the use of the two flow paths provided by conduits 20 and 22 could be modified with the use of a single flow path and a vaporizer 24 and an exhaust gas heat exchanger 26 in such single flow path. In such case, however, provision would have to be made for flow control of coolant and/or exhaust. Furthermore, it is possible to produce an embodiment in accordance with the present invention with only a vaporizer 24 and, as discussed below, with such vaporizer in direct heat transfer contact with the hydraulic fluid or in a heat transfer relationship of a heat transfer fluid such as also discussed below.

At high flow rates for the pressurized liquid stream, diverter valve 18 can be set to recover the optimum amount of heat from both the pumped hydraulic fluid and engine exhaust within vaporizer 24 and exhaust gas vaporizer 26. At low flow rates, where less heat is required for vaporization, the entire flow may be diverted to the first pressurized liquid flow path provided by conduit 20 so that vaporization of the pressurized liquid stream is effected solely within vaporizer 24.

A first hydraulic power generation system is provided by first diesel engine 30 that, by way of a shaft 34, drives a gear box 36 that in turn drives a set of first and second hydraulic pumps 38 and 40. A second hydraulic power generation system is provided by second diesel engine 32 that, through shaft 43, drives a gear box 44 that in turn drives another set of first and second hydraulic pumps 46 and 48.

The first hydraulic pumps 38 and 46 pump hydraulic fluid through a first path of a hydraulic flow circuit that returns the hydraulic fluid back to the inlets of the first hydraulic pumps 38 and 46. The second hydraulic pumps 40 and 48 pump the hydraulic fluid through second flow path of the hydraulic flow circuit.

The first flow path provided for the hydraulic fluid is from the first hydraulic pumps 38 and 46, through conduits 50 and 52 that join and are connected to a first adjustable back pressure valve 54. The hydraulic fluid then enters into a hydraulic transmission gear box 56 having hydraulic motors 58, 60 and 62 to drive an output shaft 64 that in turn drives cryopump 14 of triplex design. The hydraulic fluid then passes through a hydraulic fluid heat exchanger 66.

It is to be noted that the first and second hydraulic pumps 38, 46; and 40, 48, gear box 56 and hydraulic motors 58, 60 and 62 are all conventional hydraulic transmission devices that are well known in the art and that can be obtained from a variety of manufacturers.

The second flow path for the hydraulic fluid is from the two second hydraulic pumps 40 and 48 through conduits 68 and 70, respectively, to a second adjustable back pressure valve 72. A conduit 74 receives hydraulic fluid from second adjustable back pressure valve 72 to allow such hydraulic fluid to join the hydraulic fluid from the first flow path. The hydraulic fluid is then fed to hydraulic fluid heat exchanger 66 which is of plate design. In this regard, such feed can be a junction or manifold-like device to accomplish the joining of the flows. Alternatively, hydraulic fluid heat exchanger 66 could have separate passes for the two flow paths.

The hydraulic fluid passes from hydraulic fluid heat exchanger 66 through a conduit 78 having a branch 80 feeding the first set of first and second hydraulic pumps 38 and 40 and a conduit 82 feeding the second set of first and second hydraulic pumps 46 and 48.

It is to be noted that although two engines, sets of pumps and flow paths are illustrated, an embodiment of the present invention could be constructed with a single engine, two pumps and one set of first and second flow paths. In this regard, a single one of hydraulic motors 58, 60 and 62 could be used in a case of a unit of limited size and power. The illustrated embodiment shows the inherent scalability of the present invention, namely, the capacity of an apparatus constructed in accordance with the present invention to be scaled up by including one or multiple engines, sets of hydraulic pumps and associated first and second flow paths.

Heat is imparted to the hydraulic fluid, flowing with the hydraulic flow circuit described above, by frictional losses occurring within first and second sets of hydraulic pump 38, 40, 46 and 48, the hydraulic motors 58, 60 and 62 and the first and second adjustable back pressure valves 54 and 72. As the adjustable back pressure valves 54 and 72 are closed, upstream pressure on the hydraulic fluid increases its temperature. Therefore, the shaft work being done on the hydraulic fluid is converted to heat. For any given flow rate of pressurized liquid to be vaporized, the amount of heat to be added for vaporization and therefore, the outlet temperature of the pressurized vapor can be finely adjusted. The use of the adjustable back pressure valves 54 and 72 for both flow paths gives, in effect, a further degree of freedom with more accuracy than prior art devices.

Preferably, the first hydraulic pumps 38 and 46 are variable displacement pumps that can be adjusted at a constant engine RPM of first and second diesel engines 30 and 32 to control the speed of cryopump 14 and therefore the flow rate of the liquid stream being pumped. The present invention, however contemplates that less preferably, fixed output pumps could be utilized throughout. In such case, engine RPM would have to be varied to meet the flow rate requirements. Furthermore, other types of internal combustion engines could be used in place of first and second diesel engines 30 and 32. In very specialized applications that do not have a large flow rate of liquid cryogen, engine heat is not necessary for vaporization and therefore, even electric motors might be used to generate shaft work.

The shaft work of the engines and etc. converted to heat that is used in vaporization can be directly transferred to vaporizer 24. In such case there would be only a single heat exchanger with passes and the like to indirectly exchange heat from the hydraulic fluid to the pressurized liquid stream. Preferably, the heat exchange is indirect and is produced by a heat transfer fluid flowing within its own heat transfer circuit. The heat transfer fluid can be made up of the same fluid that is used as coolant for the first and second diesel engines 30 and 32. The heat transfer fluid is circulated by a hydraulic pump 84 connected to gear box 44 that in turn drives a hydraulic motor 86 that is coupled to a pump 88.

The heat transfer fluid is pumped first to vaporizer 24 and other heat transfer devices to be discussed (and designated by reference numbers 112, 116, 117 and 119) and hydraulic fluid heat exchanger 66. The heat transfer fluid then can flow through conduit 90 to a commingling chamber 92 that allows the recovery of engine water jacket heat. In this regard first and second diesel engines 30 and 32 are provided with radiators 93 and 94, respectively. Radiators 93 and 94 are controlled by thermostats 96 and 98. Heat transfer fluid, serving as coolant, flows through conduits 100 and 102 from commingling chamber 92 to the engine water jackets of first and second diesel engines 30 and 32. Coolant then flows from the engine water jackets of first and second diesel engines 30 and 32, after having been heated, through conduits 104 and 106, respectively, back to commingling chamber 92. When the thermostats 96 and 98 activate at their high temperature setting, the heat transfer fluid is diverted to radiators 93 and 94. A bypass line 108 and bypass valve 110 are provided to bypass commingling chamber 92 upon engine idling conditions. The heat transfer fluid then flows back to pump 88 by way of a conduit.

Additional heat may be added to the heat transfer fluid. For such purposes, shell and tube heat exchangers 112 and 116 are provided to transfer heat to the heat transfer fluid through indirect heat exchange with lubricating oil of cryopump 14 and the case drains of hydraulic pumps 38, 40, 46, 48 and 84, respectively. Heat may also be added through turbocharger intercoolers 117 and 119 to receive heat from turbocharged air being inducted into first and second diesel engines 30 and 32, respectively. Turbocharger intercoolers 117 and 119 are provided in addition to air-to-air heat exchangers with first and second diesel engines 30 and 32.

It is to be further noted that exhaust gas conduits 120, 122 and 124 conduct exhaust gas to exhaust gas heat exchanger 26 which discharges the engine exhaust as an exhaust stream 126.

In an example of a high flow case for apparatus 1, the diverter valve 18 is set to optimally recover the heat in the vaporizer 24 and the exhaust gas heat exchanger 26. Bypass valve 110 is set to allow flow into the commingling chamber 92 to recover all of the engine water jacket heat. First hydraulic pumps 38 and 46 are set to a high displacement proportional to the desired cryogen flow rate. The first adjustable back pressure valve 54 is set based on the desired cryogen output pressure, providing engine loading proportional to cryogen rate by keeping circuit pressure near constant. Supplemental shaft loading is provided by second hydraulic pumps 40 and 48 running at full displacement at all times and being back pressured by the adjustable back pressure valve 72 as needed to meet cryogen demand. Heat exchangers 112, 116, 117, and 119 transfer heat generated by various system components to the coolant.

In an operation of apparatus 1 in a low flow case, the diverter valve 18 is set to recover the heat in only the vaporizer 24. The bypass valve 110 allows flow to go through conduit 108 and thus, around the commingling chamber 92 to allow the engine water jacket heat to be dissipated by the engine radiators 93 and 94. The first hydraulic fluid pumps 38 and 46 are set to a low displacement proportional to the desired cryogen flow rate. The first adjustable back pressure valve 54 is set based on the desired cryogen output pressure, providing engine loading proportional to cryogen rate by keeping circuit pressure near constant. The second hydraulic fluid pumps 40 and 48 run at full displacement at all times and typically are not being back pressured by the second adjustable back pressure valve 72 as typically no extra heat is needed to heat the cryogen at low rates. Heat exchangers 112, 116, 117 and 119 transfer heat generated by various system components to the heat transfer fluid. Very little heat is generated at low rates.

The following table represents calculated examples for various potential operating conditions of apparatus 1. In the examples, the difference between the Total Horsepower Required and the Shaft Horsepower Required represents the level of heat energy required for vaporization expressed in horsepower. The Shaft Horsepower Requires is therefore, the energy addition required for pressurization.

TABLE

| Case Conditions | Flow Rate (scfh of $N_2$) | Pressure (psig) | Total Horsepower Required (HP) | Shaft Horsepower Required (HP) |
|---|---|---|---|---|
| High Pressure, High Flow Rate | 400,000 | 15,000 | 1890 | 630 |
| High Pressure, Low Flow Rate | 21,000 | 15,000 | 100 | 35 |
| Low Pressure, High Flow Rate | 400,000 | 2,000 | 1890 | 85 |
| Low Pressure, Low Flow Rate | 21,000 | 2,000 | 100 | 5 |

The apparatus 1 can be operated manually by setting an engine speed for both first and second diesel engines 30 and 32 that is appropriate to the power required for the particular operating condition and in accordance with the manufacturer's performance data for the particular engines used. The displacement of the two first hydraulic pumps 38 and 46 is set to obtain the required delivery rate of product. The associated first adjustable back pressure valve 54 is then set to obtain the design pressure for the first hydraulic flow path. This eliminates a degree of freedom. Diverter valve 18 is then adjusted to obtain an exhaust temperature of no less than about 400° F. as measured at the exit of the exhaust gas vaporizer 26. The second adjustable back pressure valve 72 is then adjusted to maintain the required heat transfer fluid temperature. As can be appreciated, pressure and temperature measurements can be obtained by suitable instrumentation, namely, temperature and pressure sensors, built into apparatus 1. Furthermore, the foregoing operational scheme could easily be controlled by a programmable logic controller. It is to be noted, however, that since there are several degrees of freedom under which apparatus 1 can be adjusted, there are obviously many different operating sequences that may reasonably be applied to obtain the required performance for apparatus 1.

While the present invention has been described with reference to a preferred embodiment, as will occur to those skilled in the art, numerous, changes, additions and omissions may be made without departing from the spirit and the scope of the present invention.

We claim:

1. An apparatus for producing a pressurized vapor stream comprising:

a cryopump to pump a cryogenic stream and thereby to produce a pressurized liquid stream;

a hydraulic transmission to drive the cryopump;

at least one hydraulic power generation system having a source of shaft power and first and second hydraulic pumps driven by the source of shaft power, the first of the hydraulic pumps being a variable displacement pump;

a hydraulic flow circuit for circulating the hydraulic fluid, the hydraulic flow circuit having at least first and second hydraulic fluid flow paths for the hydraulic fluid, the first of the flow paths connecting the first of the hydraulic pumps to the hydraulic transmission so that adjustment of pumping output of the first of the hydraulic pumps controls the flow rate of the cryogenic liquid stream and the second of the hydraulic fluid flow paths connected to the second of the pumps and bypassing the hydraulic transmission so that none of the shaft power imparted to the hydraulic fluid by the second of the pumps is utilized in pumping the cryogenic stream;

first and second adjustable back pressure valves connected to the first and second hydraulic flow paths, respectively, downstream of the first and second of the hydraulic pumps, to allow for independent adjustment of heat generation within hydraulic fluid flowing in the first and second flow paths; and at least a heat exchanger for indirectly exchanging heat from the hydraulic fluid to the pressurized liquid stream, thereby to vaporize at least part of the liquid stream and form the pressurized vapor stream.

2. The apparatus of claim 1, further comprising:

the heat exchanger being a hydraulic fluid heat exchanger positioned within the hydraulic flow circuit downstream of the second of the adjustable back pressure valves and the hydraulic transmission;

a vaporizer connected to the cryopump; and a heat transfer fluid circuit connected to the hydraulic fluid heat exchanger and the vaporizer so that the heat is indirectly transferred from the hydraulic fluid to a heat transfer fluid circulated within the heat transfer fluid circuit by a circulation pump and then from the heat transfer fluid to theat least part of the pressurized liquid stream.

3. The apparatus of claim 2, further comprising:

the source of shaft power being an internal combustion engine generating a heated exhaust;

first and second pressurized liquid flow paths, each, at one end, connected to a diverter valve in turn connected to the cryopump so that flow of the pressurized liquid can be divided between the first and second pressurized flow paths;

the first of the pressurized liquid flow paths connected to the vaporizer to vaporize the part of the pressurized liquid stream;

the second of the pressurized liquid flow paths connected to an exhaust gas heat exchanger to indirectly transfer further heat from the heated exhaust to vaporize a remaining part of the pressurized liquid stream flowing within the second of the pressurized liquid flow paths; and the first and second pressurized liquid flow paths connected to one another, downstream of the vaporizer and exhaust gas heat exchanger, to discharge the pressurized vapor.

4. The apparatus of claim 3, wherein:

the at least one hydraulic power generation system comprises a first hydraulic power generation system and a second hydraulic power generation system and the internal combustion engine providing the source of shaft power for the first hydraulic power generation system is a first internal combustion engine and the internal combustion engine providing the source of shaft power for the second hydraulic power generation system is a second internal combustion engine;

the at least first and second hydraulic fluid flow paths comprise two sets of the first and second hydraulic fluid flow paths; and one of the two sets of the first and second hydraulic fluid flow paths is connected to the first hydraulic power generation system and the other of the two sets of the first and second hydraulic fluid flow paths is connected to the second hydraulic power generation system and with the first of the hydraulic fluid flow paths of the two sets of the first and second hydraulic fluid flow paths connected to the first adjustable back pressure valve and the second of the hydraulic fluid flow paths of the two sets of the first and second hydraulic fluid flow paths connected to the second adjustable back pressure valve.

5. The apparatus of claim 1 or claim 4, wherein the hydraulic fluid heat exchanger is connected to both the first and second hydraulic fluid flow paths so that hydraulic fluid from the first and second hydraulic fluid flow paths mixes.

6. The apparatus of claim 4, wherein:

each of the first and second internal combustion engines is a liquid-cooled diesel engine having a radiator; and the engine water jacket of each of the first and second combustion engines is directly connected to the heat transfer fluid circuit downstream of the hydraulic fluid heat exchanger so that the heat transfer fluid is in part returned to the first and the second internal combustion engines as coolant and is further heated by the first and the second internal combustion engines.

7. The apparatus of claim 6, further comprising cryopump, hydraulic pump and engine turbocharger intercoolers located between the hydraulic fluid heat exchanger and the vaporizer to transfer yet further heat from cryopump lubricant, hydraulic pump case drain flows for the first and second hydraulic pumps, and charge air to engine turbochargers of the first and second internal combustion engines, respectively.

8. The apparatus of claim 7, wherein the hydraulic transmission is a gearbox driven by at least one hydraulic motor.

9. A method of producing a pressurized vapor stream comprising:

pumping a cryogenic stream to produce a pressurized liquid stream;

vaporizing the pressurized liquid stream to produce the pressurized vapor stream;

pumping hydraulic fluid through at least first and second hydraulic fluid flow paths of a hydraulic flow circuit that circulates the hydraulic fluid;

driving a cryopump to pump the cryogenic stream by hydraulic fluid pumped within the first of the hydraulic fluid flow paths to a hydraulic transmission coupled to the cryopump, the second of the hydraulic fluid flow paths bypassing the hydraulic transmission so that none of the hydraulic fluid within the second of the hydraulic fluid flow paths is utilized in pumping the cryogenic stream;

generating heat and independently controlling an amount of the heat generated within the hydraulic fluid flowing within the first and second flow paths by first and second adjustable back pressure valves connected to the first and second of the flow paths, respectively;

transferring the heat from the hydraulic fluid to at least in part vaporize the pressurized liquid stream; and adjusting pumping output within the first of the flow paths to control flow rate within the liquid stream.

10. The method of claim 9, wherein the heat is indirectly exchanged to the pressurized liquid stream by indirectly exchanging the heat from the hydraulic fluid downstream of the second of the adjustable back pressure valves and the hydraulic transmission to a heat transfer fluid circulated within a heat transfer fluid circuit and the heat exchange fluid, after having been heated by the hydraulic fluid, to the pressurized liquid stream.

11. The method of claim 10, wherein:

the hydraulic fluid is pumped within the first and second hydraulic fluid flow paths by first and second hydraulic pumps, respectively;

the first of the hydraulic pumps is a variable displacement pump; and the pumping output in the first of the hydraulic flow paths is adjusted by adjusting the first of the hydraulic pumps.

12. The method of claim 10, wherein:

the first and second hydraulic pumps are driven by an internal combustion engine that generates a heated exhaust;

diverting the pressurized liquid stream between first and second pressurized liquid flow paths;

vaporizing that at least part of the pressurized liquid stream within the first pressurized liquid flow path with the heat generated within the hydraulic fluid; and vaporizing a remaining part of the pressurized liquid stream through indirect heat exchange with exhaust gases produced by the internal combustion engine.

13. The method of claim 12, wherein:

the internal combustion engine being a first internal combustion engine and the first and second hydraulic pumps are a first set of first and second hydraulic pumps driven by the first internal combustion engine;

the at least first and second hydraulic fluid flow paths comprise two sets of the first and second hydraulic fluid flow paths;

one of the two sets of the first and second hydraulic fluid flow paths is connected to the first set of the first and second hydraulic pumps;

the hydraulic fluid within the other the two sets of the first and second hydraulic fluid flow paths is pumped by a second set of the first and second hydraulic pumps driven by a second internal combustion engine that generates further heated combustion gases that indirectly exchange heat with the remaining part of the pressurized liquid stream; and back pressure in the first of the hydraulic fluid flow paths of both of the two sets of the first and second hydraulic fluid flow paths is adjusted by the first adjustable back pressure valve; and back pressure in the second of the hydraulic fluid flow paths of both of the two sets of the first and second hydraulic fluid flow paths is adjusted by the second adjustable back pressure valve.

14. The method of claim 9 or claim 13, wherein the hydraulic fluid from the first and second hydraulic fluid flow paths mixes prior to exchanging heat.

15. The method of claim 14, further comprising further heating the heat transfer fluid after the heat exchange between the hydraulic fluid and the heat transfer fluid by introducing a portion of the heat transfer fluid as coolant into the first and second internal combustion engines and discharging said portion of the heat transfer fluid and combining the same with a remaining portion of the heat transfer fluid after having been utilized as coolant within the first and second internal combustion engines.

16. The method of claim 10 further comprising transferring further heat to the heat transfer fluid from cryopump lubricant, hydraulic pump case drain flows for the first and second hydraulic pumps and charge air from the engine turbochargers of the first and second internal combustion engines.

17. The method of claim 9 wherein the liquid cryogen is liquid nitrogen.

18. The method of claim 16, wherein the liquid cryogen is liquid nitrogen.

* * * * *